United States Patent [19]

Holtzberg et al.

[11] Patent Number: 4,726,334

[45] Date of Patent: Feb. 23, 1988

[54] COMPOSITE CYLINDER HOUSING AND PROCESS

[75] Inventors: Matthew W. Holtzberg, Ringwood, N.J.; Steven J. Henke, Woodridge; Lawrence D. Spaulding, Naperville, both of Ill.

[73] Assignee: Amoco Corporation, Chicago, Ill.

[21] Appl. No.: 908,729

[22] Filed: Sep. 18, 1986

[51] Int. Cl.[4] ..... F02F 7/00

[52] U.S. Cl. ..... 123/195 R; 264/236; 264/328.1

[58] Field of Search ..... 123/195 R; 264/236, 264/328.1

[56] References Cited

U.S. PATENT DOCUMENTS

| | | | |
|---|---|---|---|
| 3,748,304 | 7/1973 | Stephens | 528/210 |
| 4,016,140 | 4/1977 | Morello | 264/331.19 |
| 4,224,214 | 9/1980 | Chen | 524/437 |
| 4,433,652 | 2/1984 | Holtzberg et al. | 123/188 AA |
| 4,440,069 | 2/1984 | Holtzberg et al. | 92/224 |

*Primary Examiner*—John E. Kittle
*Assistant Examiner*—James J. Seidleck
*Attorney, Agent, or Firm*—Robert G. Ladd; William H. Magidson; Ralph C. Medhurst

[57] ABSTRACT

A lightweight composite cylinder housing is provided to decrease fuel consumption, attenuate noise, and permit increased speed of operation.

20 Claims, 4 Drawing Figures

COMPOSITE CYLINDER HOUSING AND PROCESS

BACKGROUND OF THE INVENTION

This invention relates to engines, and more particularly, to engine parts and a process for making the same.

Traditionally, engines have been made of metal, usually steel or cast iron. Steel and cast iron engines are useful, except they are quite heavy and consume considerable amounts of gasoline or diesel fuel. Conventional engines exert large compressive forces, considerable torque, and substantial secondary harmonic vibrations which have to be dampened by counterbalancing pistons, flywheels, dampeners, etc. The moving metal parts of cast iron and steel engines generate high centrifugal reciprocating, and inertial forces, momentum, and loads. Generally, the weight of the engine adversely affects its performance, efficiency, and power.

Recently, it has been suggested to use plastic engine parts in automotive engines. Such suggestions have appeared in the December 1980 issue of *Automotive Industries* at pages 40–43, in an article entitled, "What . . . a Plastic Engine? "; in the May 8, 1980 issue of *Machine Design*, Volume 52, No. 10, in an article entitled "Plastic Engine Is Off And Running"; in the September 1982 issue of Popular Science at page 71 in an article entitled "Ford's Impossible Plastic Engine"; in the Feb. 20, 1984 issue of Design News at page 46 in an article entitled, "Plastic Engine Parts Cut Total Engine Weight in Half"; in the May 6, 1985 issue of Design News at page 62 in an article entitled, "Applying the Plastic Engine and in French Application No. 2,484,042, published Dec. 11, 1981."

An experimental prototype engine with concealed plastic engine parts was displayed at the Society of Automotive Engineers' (SAE) Show in Detroit, Mich. in February 1980.

Over the years, amide-imide polymers have been developed for use in molding and producing various products, such as wire coatings, enamels, films, impregnating materials, and cooking utensils. Typifying these prior art amide-imide products, polymers and molding processes are those described in U.S. Pat. Nos. 3,546,152; 3,573,260; 3,582,248; 3,660,193; 3,748,304; 3,753,998; 4,016,140; 4,084,144; 4,136,085; 4,186,236; 4,167,620; and 4,224,214. These prior art products, polymers, and molding processes have met with varying degrees of success.

It is, therefore, desirable to provide a lightweight engine part. Amide-imide polymers have been developed for improved lightweight composite engine parts such as:

a wrist pin, U.S. Pat. No. 4,430,906;
a timing gear, U.S. Pat. No. 4,433,964;
a rocker arm, U.S. Pat. No. 4,430,969;
a piston ring, U.S. Pat. No. 4,432,925;
a valve, U.S. Pat. No. 4,433,652;
a tappet, U.S. Pat. No. 4,430,970;
a valve spring retainer, U.S. Pat. No. 4,432,311;
a piston, U.S. Pat. No. 4,440,069;
a push rod, U.S. Pat. No. 4,453,505; and
a connecting rod, U.S. Pat. No. 4,458,555.

SUMMARY OF THE INVENTION

An improved lightweight composite engine part is provided for use in gasoline and diesel powered automotive engines, truck engines, aircraft engines, marine engines, single and two cylinder engines, such as lawn mower engines, portable generators, and other internal combustion engines. The lightweight composite engine part decreases gasoline and fuel consumption, attenuates noise for quieter performance, and permits increased speed of operation. The lightweight composite engine part produces higher horsepower for its weight than conventional engine parts, while maintaining its shape, dimensional stability, and structural integrity at engine operating conditions. The lightweight composite engine part decreases centrifugal, reciprocating, and inertial forces, momentum, and load on the engine.

The composite engine part has a greater stiffness-to-weight ratio than metal, is flame resistant, and is stable to heat. The composite engine part is capable of effectively functioning at engine operating temperatures and start-up conditions during hot and cold weather. The composite engine part has high mechanical strength, thermal stability, fatigue strength, and excellent tensile, compressive, and flexural strength. The composite engine part is resistant to wear, corrosion, impact, rupture, and creep, and reliably operates in the presence of engine fuels, oils, and exhaust gases.

In contrast to metals, such as cast iron, steel, aluminum, titanium, and to thermosetting resins, such as epoxy resin, the composite engine part can be injection molded. Injection molding permits closer tolerances with less secondary machining operations for production efficiency and economy. Finished surfaces of injected molded composite engine parts are of better quality and have fewer knit lines, seams and flashes than do engine parts made from cold metal forging, casting, fabrication, or other conventional techniques. If desired, some of the composite engine parts can be insert molded or compression molded.

The lightweight composite engine part is made of durable, impact-resistant, hybrid or composite material which includes special proportions of an amide-imide resinous polymer, preferably reinforced with graphite and/or glass fibers. The amide-imide resinous polymer can also be blended with polytetrafluoroethylene (PTFE) and/or titanium dioxide. Composite engine parts which are injection molded or otherwise made from amide-imide resinous polymers have better elongation, stiffness, moduli, and strength at engine operating conditions than do other plastics, such as epoxy resin, polyimides, aramides, polyphenylene sulfide, polytetrafluoroethylene, and nylon. A particularly suitable amide-imide resinous polymer is commercially available from Amoco Chemicals Company under the trademark and product designation TORLON.

While thermoplastic parts can be compression molded, they are preferably injection molded for closer tolerances, minimized secondary machining operations, enhanced strength and lower cost.

A more detailed explanation of the invention is provided in the following description and appended claims taken in conjunction with the accompanying drawings.

DETAILED DESCRIPTION OF THE PREFERRED EMBODIMENT

Figure 1:
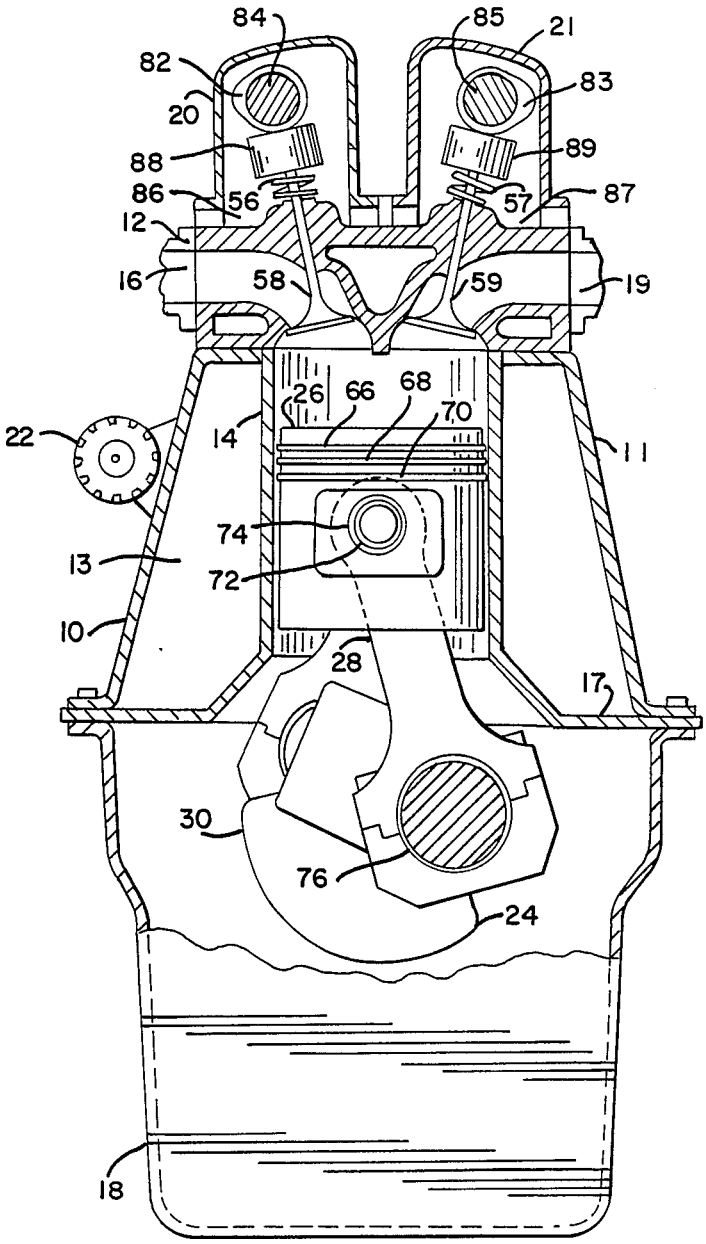
FIG. 1 is a fragmentary cross-sectional view of an automotive engine with a composite cylinder housing in accordance with principles of the present invention.

The automotive engine 10 of FIG. 1 has lightweight composite engine parts to reduce its weight, decrease fuel consumption, and improve engine performance. Engine 10 is a gasoline powered, four stroke, spark ignition engine. The illustrated engine is a Straight-4 engine with 4 cylinders arranged in an aligned cylinder firing pattern.

While the composite engine parts are described hereinafter with particular reference to the illustrated engine, it will be apparent that the engine parts can also be used in other types of gasoline powered automotive engines, as well as in diesel powered automotive engines, truck engines, aircraft engines, marine engines, locomotive engines, lawn mower engines, portable generators, and other internal combustion engines. The composite engine parts can be used in 1,2,3,4,6,8 or more cylinder engines including V-arranged cylinder engines, aligned cylinder engines, horizontally opposed cylinder engines, rotary engines, etc.

As shown in FIG. 1, engine 10 has a composite cylinder housing 11 and a cast iron head 12. The composite cylinder housing 11 has a cooling chamber 13 and four combustion chambers 14 with cast iron walls which provide cylinders. The head has an intake manifold 16 and an exhaust manifold 19 which communicate with the cylinders and an overhead carburetor (not shown). Extending below the composite cylinder housing 11 is an oil pan 18. Between composite cylinder housing 11 and oil pan 18 is a block pan bottom plate 17. Extending above the head are rocker arm covers 20 and 21. A distributor 22 with an internal set of spark plugs (not shown) is provided to ignite the gaseous air mixture in the cylinders.

A metal crankshaft 24 drives the pistons 26 through connecting rods 28. A counterweight 30 on crankshaft 24 balances the pistons. The crankshaft 24 drives a metal camshaft through a set of timing gears (not shown). In some types of engines, the crankshaft gear drives the camshaft gear directly without a timing belt or timing chain.

Metal cams 82 and 83 on camshafts 84 and 85 reciprocatingly drive the valve trains 86 and 87, respectively. There are two or four valve trains per cylinder depending on the type of engine. Each valve train has a tappet 88 or 89, a compression spring 56 or 57, and a valve 58 or 59 which opens or closes the intake manifold 16 or the exhaust manifold 19. The intake valve 58 opens and closes the intake manifold 16. The exhaust valve 59 opens and closes the exhaust manifold 19.

A piston 26 reciprocatingly slides against a metal liner that provides the cylinder walls. A set of piston rings is press fit or snap fit on the head of the piston. The piston ring set includes a compression ring 66, a barrier ring 68, and an oil scraper ring 70. The piston is pivotally connected to the connecting rod 28 through a wrist pin 72 and a bushing 74. The connecting rod is pivotally connected to the crankshaft 24 through a split ring metal bearing 76.

In a four stroke internal combustion engine, such as the illustrated engine, each piston has an intake stroke, a compression stroke, a power stroke, and an exhaust stroke. During the intake stroke, the piston moves downward and the inlet valve is opened to permit a gaseous air mixture to fill the combustion chamber. During the compression stroke, the intake and exhaust valves are closed and the piston moves upward to compress the gaseous air mixture. During the power stroke, the gaseous air mixture in the combustion chamber is ignited by the spark plug and the rapidly expanding combustion gases drive the piston downward. During the exhaust stroke, the exhaust valve is opened and the piston moves upward to discharge the combustion gases (exhaust gases).

The cylinder housing, as well as connecting rods, wrist pins, barrier piston rings, push rods, rocker arms, valve spring retainers, intake valves, cylinder housing bottom plate, and timing gears, can be made of metal, although it is preferred that they are at least partially made of a thermoplastic, amide-imide resinous polymer to reduce the weight of the engine. Such amide-imide engine parts are referred to as composite engine parts. In some engines, the intake valve can also be at least partially made of a thermoplastic, amide-imide resinous polymer.

Figure 2:
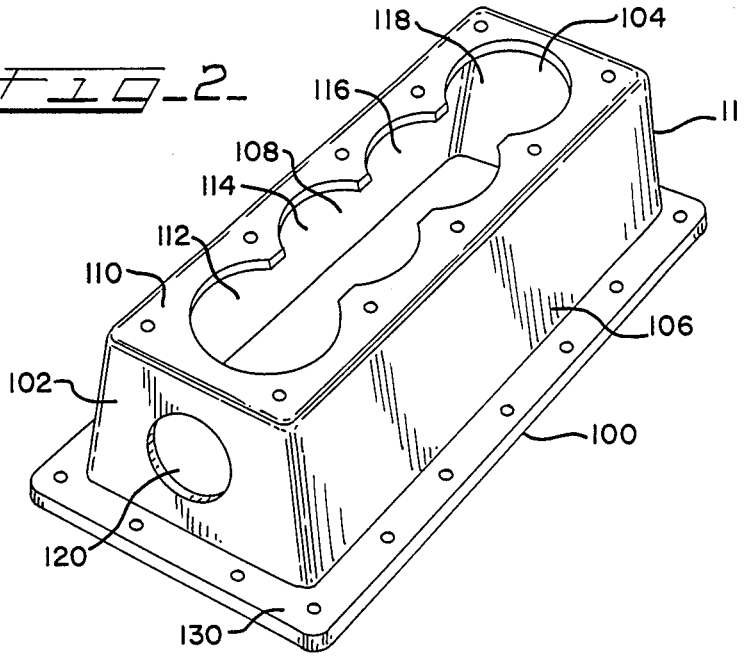
FIG. 2 is a perspective view of the composite cylinder housing.
Figure 3:
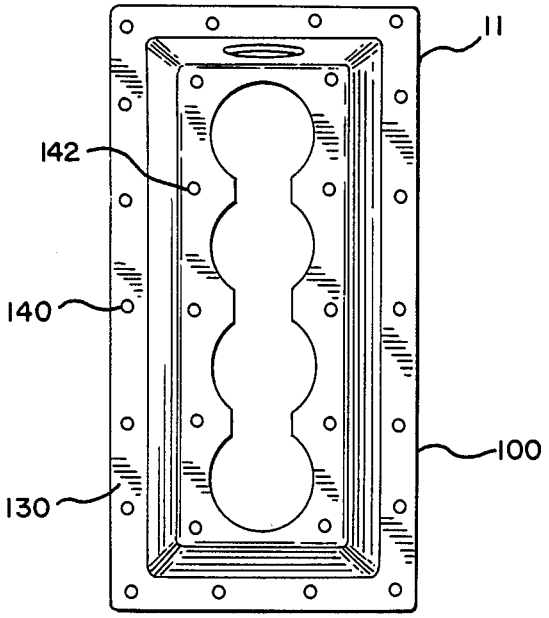
FIG. 3 is a top plan view of the composite cylinder housing.
Figure 4:
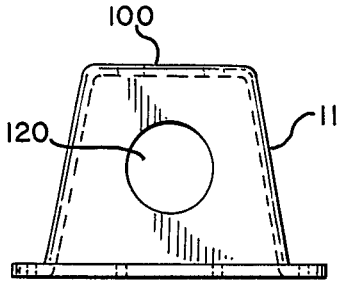
FIG. 4 is an end plan view of the composite cylinder housing.

As shown in FIGS. 2–4, the composite cylinder housing 11 has a main body portion 100 which has a generally rectangular form with a front end 102 and a back end 104 and sides 106 and 108 that slope upwardly and inwardly from a planar outwardly extending bottom flange 130 and ends and sides merge with a planar top 110 having four generally circular aperatures 112, 114, 116, and 118 formed in the planar top to receive cast iron walls which provide the cylinders, and a generally circular aperature 120 in the front end of the composite cylinder housing to receive a means for circulating a coolant. Additionally, a plurality of aperatures 140 are present in the bottom flange and a plurality of aperatures 142 are present in the planar top to receive fasteners. Optionally, aperatures may be present on the front end of the composit cylinder housing to receive the means for circulating a coolant.

The composite cylinder housing is approximately 70% lighter than conventional metal cylinder housings. Advantageously, the composite cylinder housing maintains its structural shape and integrity at engine operating conditions. The coefficient and rate of thermal expansion and contraction of the amide-imide polymeric cylinder housing are similar to those of the metal cylinder housing bottom plate, so that the thermoplastic cylinder housing expands and contracts compatibly with the metal cylinder housing bottom plate at engine operating conditions.

The composite cylinder housing is preferably injection molded for closer tolerances, minimal secondary machining operations, and enhanced structural strength. An injection mold provides a die with an upper molding portion and a lower molding portion. The cavity should be well vented at the parting line with vents preferably from 0.002 inch to 0.004 inches deep, and should have a draft of at least 0.5° to 1.5° to facilitate removal of the molded cylinder housing. An inlet or sprue allows the injection moldable, amide-imide resinous polymer to flow into the cavity of the mold. A removable core is inserted into the cavity of the mold to help form the cylinder housing. The core cooperates with the cavity to define a generally cylinder housing-shaped molding chamber.

In order to minimize flow lengths in the injection molding of the composite cylinder housing, the sprue should be located in the center of the cavity, opposite the core. During injection molding, the amide-imide resinous polymer is injected into the molding cavity through the sprue at injection molding temperatures and pressures to fill the cavity and molding chamber, so as to form a thermoplastic, amide-imide resinous polymeric cylinder housing-shaped blank. The blank should then be allowed to cool below its plastic deformation temperature to solidify its shape and polymeric orientation. The injection molding temperature (polymer melt temperature) of the polymer is preferably from 630° F. to 670° F., which is above the plastic deformation temperature of the amide-imide polymer. The total molding and cooling time ranges from 60 to 250 seconds, depending on the grade of the polymeric resin and the desired cross-sectional thickness of the molded cylinder housing.

After the cylinder housing-shaped blank has cooled below its plastic deformation temperature, the mold is opened and the blank is stripped from the core. Thereafter, the resinous sprue and runners are removed, either manually or mechanically, to form a cylinder housing-shaped blank.

The cooled molded engine part providing the blank is then post cured by solid state polymerization by progressively heating the molded engine part, below its heat deflection temperature, to enhance the strength of the composite cylinder housing. The specific time and temperatures depend upon the size of the molded part.

In the preferred method of post curing, the molded engine part is heated in the presence of a circulating gas in an oven for a period of time such that a major portion of the volatiles contained in the injection molded engine part are vaporized and removed, while simultaneously increasing the heat deflection temperature of the polymer from about 15° F. to 35° F. without deformation of the engine part. Heating can be carried out by heating the molded part from an initial temperature to a final temperature with either continuous or stepwise increases in temperature over a period of time, or at a single temperature, for a sufficient time to vaporize and remove the volatiles and increase the heat deflection temperature of the polymer.

Imidization, cross-linking and chain extension take place during heating. Continuous or stepwise heating increases flexural and tensile strengths, tensile elongation, and heat deflection temperature properties of the molded composite engine parts.

In order to enhance the physical properties of smaller molded engine parts, it is preferred to continuously heat the molded part from an initial temperature of 300° F. to 330° F. to a final temperature of 490° F. to 510° F. for about 40 to 60 hours. Alternatively, the injection molded composite engine part can be heated in a stepwise manner from an initial temperature of 300° F. to 330° F. for 20 to 30 hours to a final temperature of 450° F. to 470° F. for 20 to 30 hours.

Generally, the molded part is heated (post cured) at a temperature of about 330° F. for 24 hours, about 420° F. for 24 hours, about 450° F. for 48 hours, about 470° F. for 48 hours and about 500° F. for 240 hours. More specifically, the molded article is heated in the presence of a circulating gas at about 5° F. to 25° F., and preferably about 5° F. to 15° F., below the increased heat deflection temperature of the polymer for a period of time such that substantial imidization, chain extension and crosslinking take place without deformation of the molded article.

As a result of such heating, water and gases continue to be generated and removed, and the molecular weight and heat deflection temperature of the polymer are increased. Heating is continued for a period of time sufficient to increase the heat deflection temperature by about 50° F. to 70° F. Preferably, the heating is at a temperature ranging from about 420° F. to 450° F. for a period of at least 20 hours. Thereafter, the temperature is increased to about 5° F. to 25° F. below the polymer's new heat deflection temperature and held at the new temperature for a sufficient time to increase the polymer's heat deflection temperature by about 15° F. to 35° F. Preferably, such heating is at about 470° F. to 510° F. for a period of at least 20 hours.

Heating is continued in this manner to increase the polymer's heat deflection temperature to its maximum attainable value without deformation of the molded article. The final heating stage is carried out at about 5° F. to 25° F. and preferably from about 5° F. to 15° F., below the maximum attainable temperature for at least 20 hours, and most preferably at least 40 hours. The heated part is then cooled.

In order to best enhance the physical properties of the molded composite engine part, it is preferred to heat the molded part from about 320° F. to about 350° F. for about 20 to 30 hours, then from about 420° F. to 450° F. for about 40 to 50 hours, then from about 470° F. to about 480° F. for about 40 to 60 hours and subsequently from about 490° F. to about 510° F. for about 170 to 200 hours.

Post curing should be carried out in the presence of a circulating gas which flows through and around the molded engine part to remove water and gases from the polymeric resin. The amount of circulation and the circulation flow pattern should be coordinated to maximize removal of water and the gases without causing substantial variations in temperature. While inert gases, such as nitrogen, can be used, it is preferred that the circulating gas be an oxygen-containing gas, most preferably air, because oxygen tends to facilitate cross-linking of the polymer molecules. Post curing is preferably carried out in a circulating air oven, although it can be carried out in any other suitable apparatus.

Dry, post-cured engine parts are resistant to thermal shock at temperatures of at least 500° F. and exhibit significantly improved flexural and tensile strengths, tensile elongation and heat deflection temperature properties compared with untreated, molded amide-imide resinous engine parts. A more detailed explanation of heat treatment by post curing is described in Chen U.S. Pat. No. 4,167,620, which is hereby incorporated by reference.

After the molded composite cylinder housing engine part is post cured, undersized aperatures, to receive the metal cylinder walls are cut in the planar top of the composite cylinder housing and an undersized aperature, to receive a means for circulating a coolant, is cut in the front end of the composite cylinder housing. The cylinder wall aperatures and the aperature for the means to circulate the coolant are then honed to the desired size. Additionally, a plurality of aperatures are drilled in the flange, on the planar top and optionally on the front end of the cylinder housing to receive fasteners.

While the machining operations described above are preferably conducted after the injection molded engine part is post cured, one or more of these machining operations can be conducted before post curing if desired.

The composite engine part and the thermoplastic, amide-imide resinous polymer contained therein substantially maintain their shape, dimensional stability and structural integrity at engine operating conditions. Usual engine operating temperatures do not exceed 350° F. Oil cooled engine operating temperatures range from about 200° F. to 250° F. Advantageously, the composite thermoplastic, amide-imide resinous, polymeric engine part is impervious and chemically resistant to oil, gasoline, diesel fuel, and engine exhaust gases at engine operating conditions.

The thermoplastic resin in the composite engine part comprises 40% to 100%, preferably 65% to 75%, by weight amide-imide resinous polymer. The polymer is preferably reinforced with graphite fibers and/or glass fibers. In molded parts the fibers have an average length of 6 to 10 mils and a preferred diameter of about 0.2 to 0.4 mils. The ratio of the length to diameter of the fibers is from 2 to 70, averaging about 20. While the above fiber lengths and diameters are preferred for best structural strength, other lengths and diameters can be used, if desired. The graphite fibers can be granulated or chopped and can be optionally sized or coated with a polysulfone sizing or some other polymer which will maintain its structural integrity at engine operating conditions. The glass fibers can be milled or chopped and can be sized with silane or some other polymer that maintains its structural integrity at engine operating conditions. Chopped graphite and glass fibers are preferably sized, while granulated graphite fibers are preferably unsized.

Desirably, the thermoplastic, amide-imide resinous polymer comprises 10% to 50%, preferably 30% to 34%, by weight graphite fibers or 10% to 60%, preferably 30% to 34%, by weight glass fibers. The polymer can have as much as 3% and preferably ½% to 1% by weight powdered or granular polytetrafluoroethylene (PTFE) and/or as much as 6% by weight titanium dioxide. In some circumstances it may be desirable to add more PTFE.

The polymer's molding characteristics and molecular weight can be controlled to facilitate polymerization with an additional monomer, such as trimellitic acid (TMA), and can be prepared with the desired flow properties by the methods described in Hanson U.S. Pat. No. 4,136,085, which is hereby incorporated by reference.

The polymer can be blended with graphite, glass, PTFE, and titanium dioxide by the method described in Chen U.S. Pat. No. 4,224,214, which is hereby incorporated by reference.

The most preferred amide-imide polymer is reinforced with 30% by weight graphite fibers and has the following engineering properties:

TABLE I

| Property | Typical Value | Units | ASTM Test Method |
|---|---|---|---|
| Mechanical Properties | | | |
| Tensile Strength | | psi | D1708 |
| @ −321° F. | 22,800 | | |
| @ 73° F. | 29,400 | | |
| @ 275° F. | 22,800 | | |
| @ 450° F. | 15,700 | | |
| Tensile Elongation | | % | D1708 |
| @ −321° F. | 3 | | |
| @ 73° F. | 6 | | |
| @ 275° F. | 14 | | |
| @ 450° F. | 11 | | |
| Tensile Modulus | | psi | D1708 |
| @ 73° F. | 3,220,000 | | |

TABLE I-continued

| Property | Typical Value | Units | ASTM Test Method |
|---|---|---|---|
| Flexural Strength | | psi | D790 |
| @ −321° F. | 45,000 | | |
| @ 73° F. | 50,700 | | |
| @ 275° F. | 37,600 | | |
| @ 450° F. | 25,200 | | |
| Flexural Modulus | | psi | D790 |
| @ −321° F. | 3,570,000 | | |
| @ 73° F. | 2,880,000 | | |
| @ 257° F. | 2,720,000 | | |
| @ 450° F. | 2,280,000 | | |
| Compressive strength | 32,700 | psi | D695 |
| Shear Strength | | psi | D732 |
| @ 73° F. | 17,300 | | |
| Izod Impact | | ft.-lbs/in. | D256 |
| @ 73° F. | 0.9 | | |
| Thermal Properties | | | |
| Deflection Temperature | | °F. | D648 |
| @ 264 psi | 540 | | |
| Coefficient of Linear Thermal Expansion | $5 \times 10^{-6}$ | in./in./°F. | D696 |
| Thermal Conductivity | 3.6 | $\frac{\text{btu - in.}}{\text{hr. ft.}^2\ °\text{F.}}$ | C177 |
| Flammability | 94V0 | Underwriters Laboratories | 94 |
| Limiting Oxygen Index | 52 | % | D2863 |
| General Properties | | | |
| Density | 1.42 | g/cc | D792 |
| Hardness "Rockwell" E | 94 | | |
| Water Absorption | 0.26 | % | D570 |

The preferred, glass reinforced, thermoplastic amide-imide resinous polymer comprises 30% by weight glass fibers and has the following properties:

TABLE II

| Property | Typical Value | Units | ASTM Test Method |
|---|---|---|---|
| Mechanical Properties | | | |
| Tensile Strength | | psi | D1708 |
| @ −321° F. | 29,500 | | |
| @ 73° F. | 29,700 | | |
| @ 275° F. | 23,100 | | |
| @ 450° F. | 16,300 | | |
| Tensile Elongation | | % | D1708 |
| @ −321° F. | 4 | | |
| @ 73° F. | 7 | | |
| @ 275° F. | 15 | | |
| @ 450° F. | 12 | | |
| Tensile Modulus | | psi | D1708 |
| @ 73° F. | 1,560,000 | | |
| Flexural Strength | | psi | D790 |
| @ −321° F. | 54,400 | | |
| @ 73° F. | 48,300 | | |
| @ 275° F. | 35,900 | | |
| @ 450° F. | 26,200 | | |
| Flexural Modulus | | psi | D790 |
| @ −321° F. | 2,040,000 | | |
| @ 73° F. | 1,700,000 | | |
| @ 275° F. | 1,550,000 | | |
| @ 450° F. | 1,430,000 | | |
| Compressive Strength | 45,800 | psi | D695 |
| Shear Strength | | psi | D732 |
| @ 73° F. | 20,100 | | |
| Izod Impact | | ft-lbs/in. | D256 |
| @ 73° F. | 1.5 | | |
| Thermal Properties | | | |
| Deflection Temperature | | °F. | D648 |
| @ 264 psi | 539 | | |
| Coefficient of Linear Thermal Expansion | $9 \times 10^{-6}$ | in./in./°F. | D696 |
| Thermal Conductivity | 2.5 | $\frac{\text{btu - in.}}{\text{hr - ft}^2\ °\text{F.}}$ | C177 |

TABLE II-continued

| Property | Typical Value | Units | ASTM Test Method |
|---|---|---|---|
| Flammability | 94V0 | Underwriters Laboratories | 94 |
| Limiting Oxygen Index | 51 | % | D2863 |
| Electrical Properties | | | |
| Dielectric Constant | | | D150 |
| @ $10^3$ Hz | 4.4 | | |
| @ $10^6$ Hz | 6.5 | | |
| Dissipation Factor | D150 | | |
| @ $10^3$ Hz | .022 | | |
| @ $10^6$ Hz | .023 | | |
| Volume Resistivity | $6 \times 10^{16}$ | ohms-in. | D257 |
| Surface Resistivity | $1 \times 10^{18}$ | ohms | D257 |
| Dielectric Strength | 836 | volts/mil. | |
| General Properties | | | |
| Density | 1.56 | g/cc | D792 |
| Hardness "Rockwell" E | 94 | | |
| Water Absorption | 0.24 | % | D570 |

The amid-imide polymers are prepared by reacting an aromatic polycarboxylic acid compound (acyl halide carboxylic acid and/or carboxylic acid esters) having at least three carboxylic acid groups such as trimellitic acid (TMA), 4-trimellitoyl anhydride halide (4-TMAC), pyromellitic anhydride, pyromellitic acid, 3,4,3',4' benzophenone tetracarboxylic acid or an anhydride thereof, or oxybis benzene dicarboxylic acid or an anhydride thereof.

The amide-imide polymers are preferably prepared by reacting an acyl halide derivative of an aromatic tricarboxylic acid anhydride with a mixture of largely- or wholly-aromatic primary diamines. The resulting products are polyamides wherein the linking groups are predominantly amide groups, although some may be imide groups, and wherein the structure contains free carboxylic acid groups which are capable of further reaction. Such polyamides are moderate molecular weight polymeric compounds having in their molecule units of:

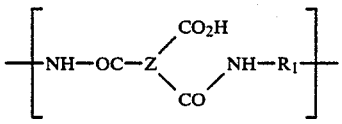

and units of:

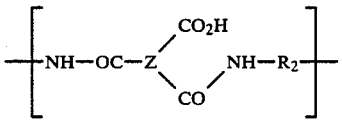

and optionally, units of:

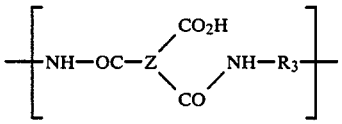

wherein the free carboxyl groups are ortho to one amide group, Z is an aromatic moiety containing 1 to 4 benzene rings or lower-alkyl-substituted benzene rings, $R_1$, $R_2$ and $R_3$ are different and are divalent wholly- or largely-aromatic hydrocarbon radicals. These hydrocarbon radicals may be a divalent aromatic hydrocarbon radical of from 6 to about 10 carbon atoms, or two divalent aromatic hydrocarbon radicals each of from 6 to about 10 carbon atoms joined directly or by stable linkages such as —10—, methylene, —CO—, —$SO_2$—, —S—; for example, —R'—0—R'—, —R'—$CH_2$—R'—, —R'—CO—R'—, —R'—$SO_2$—R'—and —R'—S—R'—.

The polyamides are capable of substantially complete imidization by heating by which they form the polyamide-imide structure having to a substantial extent recurring units of:

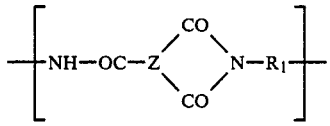

and units of:

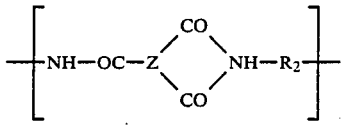

and, optionally, units of:

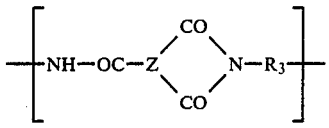

wherein one carbonyl group is meta to and one carbonyl group is para to each amide group and wherein Z, $R_1$, $R_2$ and $R_3$ are defined as above. Typical copolymers of this invention have up to about 50 percent imidization prior to heat treatment, typically about 10 to about 40 percent.

The polyamide-imide copolymers are prepared from an anhydride-containing substance and a mixture of wholly- or partially-aromatic primary diamines. Usefully the anhydride-containing substance is an acyl halide derivative of the anhydride of an aromatic tricarboxylic acid which contains 1 to 4 benzene rings or lower-alkyl-substituted benzene rings and wherein two of the carboxyl groups are ortho to one another. More preferably, the anhydride-containing substance is an acyl halide derivative of an acid anhydride having a single benzene or lower-alkyl-substituted benzene rings, and most preferably, the substance is the acyl chloride derivative of trimellitic acid anhydride (4-TMAC).

Usefully the mixture of diamines contains two or more, preferably two or three, wholly- or largely-aromatic primary diamines. More particularly, they are wholly-or largely-aromatic primary diamines containing from 6 to about 10 carbon atoms or wholly- or largely-aromatic primary diamines composed of two divalent aromatic moieties of from 6 to about 10 carbon atoms, each moiety containing one primary amine group, and the moieties linked directly or through, for example, a bridging —0—, —S—, —$SO_2$—, —CO—, or methylene group. When three diamines are used they are preferably selected from the class composed of:

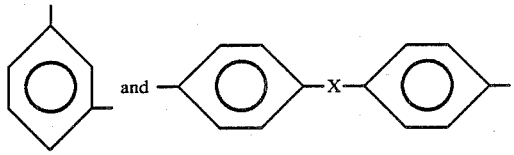

said X being an —0—, —$CH_2$—, or —$SO_2$—group. More preferably, the mixture of aromatic primary diamines is two-component and is composed of meta-phenylenediamine (MPDA) and p,p'-oxybis(aniline) (OBA), p,p'-methylenebis (aniline) (MBA) and p,p'-oxybis(aniline), p,p'-sulfonylbis(aniline) (SOBA) and p,p'-oxybis(aniline), p,p'-sulfonylbis(aniline) and meta-phenylenediamine, or p,p'-sulfonylbis(aniline) and p,p'-methylenebis(aniline). Most preferably, the mixture of primary aromatic diamines contains meta-phenylenediamine and p,p'-oxybis(aniline). The aromatic nature of the diamines provides the excellent thermal properties of the copolymers while the primary amine groups permit the desired imide rings and amide linkages to be formed.

When two diamines are used to achieve a polymer usefully combining the properties of both diamines, it is usual to stay within the range of about 10 mole % of the first diamine and 90 mole % of the second diamine to about 90 mole % of the first diamine and 10 mole % of the second diamine. Preferably the range is about a 20 to 80 mole ratio to about an 80 to 20 mole ratio. In the preferred embodiment wherein the acyl chloride of trimellitic acid anhydride is copolymerized with a mixture of p,p'-oxybis(aniline) and meta-phenylenediamine, the preferred range is from about 30 mole % of the former and about 70 mole % of the latter to about 70 mole % of the former and about 30 mole % of the latter.

Although embodiments of the invention have been shown and described, it is to be understood that various modifications and substitutions, as well as rearrangements of structural features and/or process steps, can be made by those skilled in the art without departing from the novel spirit and scope of this invention.

What is claimed is:

1. A composite engine part, comprising: a thermoplastic, amide-imide resinous polymeric cylinder housing having a main body portion having a generally rectangular form with a front end, a back end and sides that slope upwardly and inwardly from a planar outwardly extending bottom flange and that merge with a planar top having at least one first generally circular aperture formed therein with said circular aperture being generally equally spaced from the sides of said form, a second generally circular aperture formed in the front end of said main body to receive a means for circulating a coolant, a plurality of apertures in said flange, a plurality of apertures in said planar top being generally equally spaced between said first circular aperture and the sides of said main body.

2. A composite engine part in accordance with claim 1 wherein said cylinder housing comprises a reaction product of a trifunctional carboxylic acid compound and at least one diprimary aromatic diamine.

3. A composite engine part in accordance with claim 1 wherein said cylinder housing comprises at least one of the following moieties:

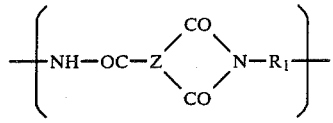

and

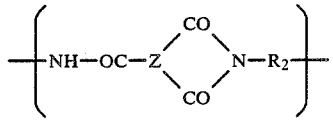

wherein one carbonyl group is meta to and one carbonyl group is para to each amide group and wherein Z is a trivalent benzene ring or lower-alkyl-substituted trivalent benzene ring, $R_1$ and $R_2$ are different and are divalent aromatic hydrocarbon radicals of from 6 to about 10 carbon atoms or two divalent aromatic hydrocarbon radicals of from 6 to about 10 carbon atoms joined directly or by stable linkages selected from the group consisting of —0—, methylene, —CO—, —SO—$SO_2$, and —S—radicals and wherein said $R_1$ and $R_2$ containing units run from about 10 mole percent $R_1$ containing unit and about 90 mole percent $R_2$ containing unit to about 90 mole percent $R_1$ containing unit and about 10 mole percent $R_2$ containing unit.

4. A composite engine part in accordance with claim 3 wherein $R_1$ is

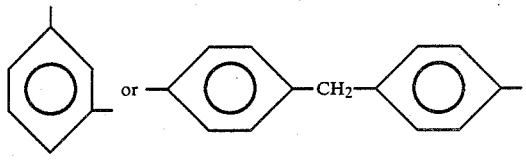

and $R_2$ is

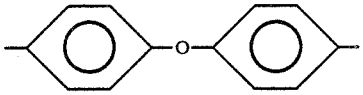

or

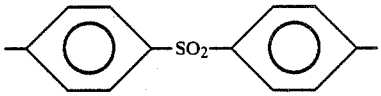

or wherein $R_1$ is

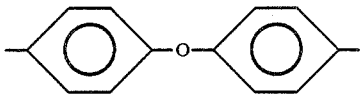

and $R_2$ is

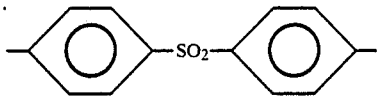

5. A composite engine part in accordance with claim 3 wherein Z is a trivalent benzene ring, $R_1$ is

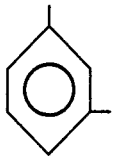

$R_2$ is

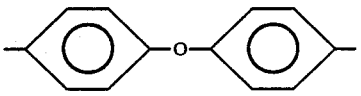

and wherein the concentration range runs from about 30 mole percent of the $R_1$ containing units and about 70 mole percent of the $R_2$ containing units to about 70 mole percent of the $R_1$ containing units and about 30 mole percent of the $R_2$ containing units.

6. A composite engine part in accordance with claim 3 wherein said cylinder housing comprises from 40% to 100% by weight amide-imide resinous polymer.

7. A composite engine part in accordance with claim 6 wherein said cylinder housing comprises from 65% to 75% by weight amide-imide resinous polymer.

8. A composite engine part in accordance with claim 3 wherein said cylinder housing comprises from 10% to 50% by weight graphite fiber.

9. A composite engine part in accordance with claim 8 wherein said cylinder housing comprises from 30% to 34% by weight graphite fiber.

10. A composite engine part in accordance with claim wherein said cylinder housing comprises 10% to 60% by weight glass fiber.

11. A composite engine part in accordance with claim 10 wherein said cylinder housing comprises 30% to 34% by weight glass fiber.

12. A process for forming a composite engine part, comprising the steps of: inserting a core in a generally cylinder housing-shaped cavity of a mold providing a die to define a generally cylinder housing-shaped molding chamber; injecting a thermoplastic, amide-imide resinous polymer into said cavity to form a generally cylinder housing-shaped blank; cooling said cylinder housing-shaped blank below its plastic deformation temperature; removing said blank from said mold; post curing said amide-imide cylinder housing-shaped blank by solid state polymerization to enhance the strength and integrity of said amideimide cylinder housing-shaped blank.

13. A process in accordance with claim 12 wherein said amide-imide polymer is prepared by reacting a trifunctional carboxylic acid compound with at least one diprimary aromatic diamine.

14. A process in accordance with claim 13 wherein said amide-imide polymer comprises one of the following moieties:

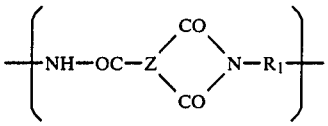

and

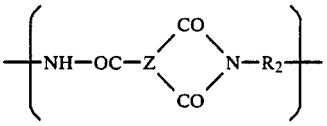

wherein one carbonyl group is meta to and one carbonyl group is para to each amide group and wherein Z is a trivalent benzene ring or lower-alkyl-substituted trivalent benzene ring, $R_1$ $R_2$ are different and are divalent aromatic hydrocarbon radicals of from 6 to about 10 carbon atoms or two divalent aromatic hydrocarbon radicals of from 6 to about 10 carbon atoms joined directly or by stable linkages selected from the group consisting of —0—, methylene, —CO—, —SO—$SO_2$—, and —S—radicals and wherein said $R_1$ and $R_2$ containing units run from about 10 mole percent $R_1$ containing unit and about 90 mole percent $R_2$ containing unit to about 90 mole percent $R_1$ containing unit and about 10 6l mole percent $R_2$ containing unit.

15. A process in accordance with claim 14 wherein $R_1$ is

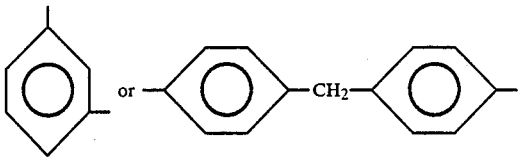

and $R_2$ is

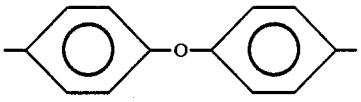

or

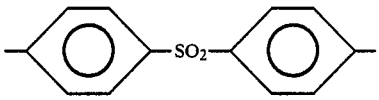

or wherein $R_1$ is

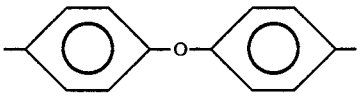

and $R_2$ is

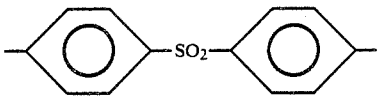

16. A process in accordance with claim 14 wherein Z is a trivalent benzene ring, $R_1$ is

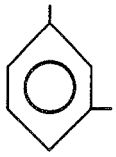

$R_2$ is

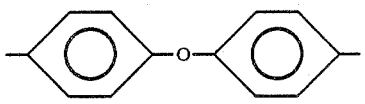

and wherein the concentration range runs from about 30 mole percent of the $R_2$ containing units and about 70 mole percent of the $R_1$ containing units to about 70 percent of the $R_2$ containing units and about 30 mole percent of the $R_2$ containing units.

17. A process in accordance with claim 14 wherein said polymer comprises from 10% to 50% by weight graphite fibers.

18. A process in accordance with claim 17 wherein said polymer comprises from 30% to 34% by weight graphite fibers.

19. A process in accordance with claim 14 wherein said polymer comprises from 10% to 60% by weight glass fibers.

20. A process in accordance with claim 19 wherein said polymer comprises from 30% to 34% by weight glass fibers.

* * * * *

UNITED STATES PATENT OFFICE
CERTIFICATE OF CORRECTION

Patent No. 4,726,334 Dated February 23, 1988

Inventor(s) Matthew W. Holtzberg, Steven J. Henke, Lawrence D. Spaulding

It is certified that error appears in the above-identified patent and that said Letters Patent are hereby corrected as shown below:

| Patent Column | Line | |
|---|---|---|
| 4 | 37 | reads "composit" and should read --composite-- |
| 6 | 52 | reads "aperatures" and should read --apertures-- |
| 6 | 54 | reads "aperature" and should read --aperture-- |
| 6 | 57 | reads "aperatures...aperature" and should read --apertures...aperture-- |
| 6 | 59 | reads "aperature" and should read --aperture-- |
| 10 | 6 | reads "such as -10-" and should read --such as -0- -- |
| 12 | 27 | reads "-SO-$SO_2$" and should read -- -$SO_2$- -- |
| 14 | 32 | reads "10 61 mole percent" and should read --10 mole percent-- |
| 16 | 8 | reads "$R_2$" and should read --$R_1$-- |

UNITED STATES PATENT OFFICE
CERTIFICATE OF CORRECTION

Patent No. 4,726,334 Dated February 23, 1988

Inventor(s) Matthew W. Holtzberg, Steven J. Henke, Lawrence D. Spaulding

It is certified that error appears in the above-identified patent and that said Letters Patent are hereby corrected as shown below:

CONTINUED

| Patent Column | Line | |
|---|---|---|
| 16 | 9 | reads "$R_1$" and should read --$R_2$-- |
| 16 | 9-10 | reads "70 percent" and should read --70 mole percent-- |
| 16 | 10 | reads "$R_2$" and should read --$R_1$" |
| 14 | 21 | reads "$R_1R_2$" and should read --$R_1$ and $R_2$-- |

Signed and Sealed this

Twenty-eighth Day of February, 1989

*Attest:*

*Attesting Officer*

DONALD J. QUIGG

*Commissioner of Patents and Trademarks*